US009809357B2

(12) United States Patent
Arnold et al.

(10) Patent No.: US 9,809,357 B2
(45) Date of Patent: Nov. 7, 2017

(54) CONTAINER WITH PIVOTING LATCH

(71) Applicant: Sonoco Development, Inc., Hartsville, SC (US)

(72) Inventors: David Alan Arnold, Schereville, IN (US); Gary Hase, Monee, IL (US)

(73) Assignee: Sonoco Development, Inc., Hartsville, SC (US)

( * ) Notice: Subject to any disclaimer, the term of this patent is extended or adjusted under 35 U.S.C. 154(b) by 33 days.

(21) Appl. No.: 15/017,715

(22) Filed: Feb. 8, 2016

(65) Prior Publication Data

US 2016/0251124 A1 Sep. 1, 2016

Related U.S. Application Data

(60) Provisional application No. 62/121,624, filed on Feb. 27, 2015.

(51) Int. Cl.

| | |
|---|---|
| ***B65D 45/22*** | (2006.01) |
| ***B65D 81/38*** | (2006.01) |
| ***B65D 43/22*** | (2006.01) |
| ***B65D 43/16*** | (2006.01) |
| ***B65D 43/26*** | (2006.01) |
| *F25D 3/06* | (2006.01) |
| *E05B 65/08* | (2006.01) |
| *A45C 11/20* | (2006.01) |

(52) U.S. Cl.

CPC ..... *B65D 43/22* (2013.01); *B65D 43/162* (2013.01); *B65D 43/265* (2013.01); *A45C 11/20* (2013.01); *E05B 65/0811* (2013.01); *F25D 2331/804* (2013.01)

(58) Field of Classification Search

CPC .... B65D 81/3818; B65D 43/22; B65D 43/24; B65D 43/162; B65D 43/265; B65D 21/0223; E05B 15/0006; E05B 2015/0235; E05B 2015/165; E05B 83/243; E05B 65/0811; E05B 15/1635; E05C 19/06; E05C 19/10; F25D 2331/804; Y10T 292/0874; Y10T 16/5285

USPC ..... 220/831, 325, 835; 292/246, 288, 250, 292/DIG. 71, DIG. 61, 103, 204, DIG. 38, 292/80, 1, 87; 206/805; 62/457.7, 457.1

See application file for complete search history.

(56) References Cited

U.S. PATENT DOCUMENTS

D2,237 S * 12/1865 Richardson ..... D8/336
633,269 A * 9/1899 Moore ..... E05C 19/06 292/246

(Continued)

FOREIGN PATENT DOCUMENTS

WO 2006/020781 A2 2/2006

*Primary Examiner* — J. Gregory Pickett
*Assistant Examiner* — Gideon Weinerth
(74) *Attorney, Agent, or Firm* — Miller, Matthias & Hull LLP

(57) ABSTRACT

A combination container and latch is provided. The container comprises a body, a lid hingedly attached to the body and a pivoting latch that minimizes the possibility of the latch becoming entangled in the lid or damaged. The latch is moveable between a locked position in which the latch is distended and extends vertically upward within a body recess and a lid recess to engage a locking post, and an open position in which the latch is relaxed and extends horizontally within the body recess. The container and latch are designed so that the latch never extends beyond the container footprint.

13 Claims, 4 Drawing Sheets

(56) References Cited

U.S. PATENT DOCUMENTS 1,490,575 A * 4/1924 Masury ..... E05B 83/243 292/1
3,618,995 A * 11/1971 McLean ..... E05C 19/14 292/113
3,690,708 A * 9/1972 Worley ..... E05B 15/022 206/1.5
3,782,765 A * 1/1974 Wallyn ..... E05C 19/10 292/103
3,985,380 A * 10/1976 Raivio ..... E05C 19/14 292/120
4,830,413 A * 5/1989 Bisbing ..... E05C 19/14 292/247
4,904,007 A * 2/1990 Woodruff ..... E05B 65/102 292/341.15
D314,683 S * 2/1991 Scanland ..... D6/552
D333,775 S * 3/1993 Krape ..... D8/331
5,353,946 A 10/1994 Behrend
D454,292 S * 3/2002 Plummer ..... D8/331
6,398,272 B1 6/2002 Plummer et al.
6,497,438 B1 * 12/2002 Holub ..... E05B 17/0025 292/240
D602,347 S * 10/2009 Allen ..... D8/382
D712,720 S * 9/2014 Seiders ..... B65D 81/3816 D8/331
8,875,934 B2 11/2014 Deka
D750,953 S * 3/2016 Jacobsen ..... D8/331
2005/0178770 A1 * 8/2005 Hase ..... B65D 25/005 220/592.2
2006/0032860 A1 2/2006 Hase
2014/0190982 A1 7/2014 Speed
2016/0251124 A1 * 9/2016 Arnold ..... B65D 43/162 220/324
2017/0113849 A1 * 4/2017 Seiders ..... B65D 45/20

* cited by examiner

CONTAINER WITH PIVOTING LATCH

BACKGROUND

Field of the Invention

This patent relates to a latch for a container. More particularly, this patent relates to an insulated shipping container having a pivoting latch.

Description of the Related Art

Typical rubber draw-latches pivot perpendicularly to the mounting face, allowing the latch to be left in a position where it can project beyond the container's footprint and become damaged. There is a need for a latch that pivots in a flat plane about its mounting point within a recessed pocket, so that the latch does not project beyond the footprint of the container when the lid is in the open or closed positions. This minimizes the possibility of it becoming entangled and then damaged. The disclosure addresses this need.

SUMMARY OF THE INVENTION

The present disclosure relates to a container having a pivoting latch. The container comprises a body, a lid hingedly attached to the body and a pivoting latch that pivots parallel to the mounting face to minimize the possibility of the latch becoming entangled in the lid or damaged. The latch is moveable between a locked position in which the latch is distended and extends vertically upward within a body recess and a lid recess to engage a locking post, and an open position in which the latch is relaxed and extends horizontally within the body recess. The container and latch are designed so that the latch never extends beyond the container footprint.

The body comprises a bottom, a front wall, a rear wall and opposing side walls forming a unitary structure defining a storage space. The front wall, the rear wall and the opposing side walls extend upward from the bottom and terminate in a ledge. The ledge has an inner perimeter and an outer perimeter. A body flange extends upward from the inner perimeter of the ledge and terminates in a rim. The rim defines an opening that communicates with the storage space. The front wall has a top edge and defines a body recess near the top edge. A pivot mount is attached to the body within the body recess.

The lid is moveable between a closed position in which the lid covers the opening and an open position allowing access to the storage space. The lid comprises a top panel and a lid flange. The lid flange has a front panel that extends downward from a front panel upper edge to a front panel lower edge. The lid top panel and the lid front panel defining a lid recess which communicates with the body recess. The lid further comprises a vertical planar surface located within the lid recess and extending upward from the front panel lower edge. A locking post extends forward from the vertical planar surface. The locking post has a top surface having a raised front edge.

The latch is resiliently flexible and is pivotally mounted to the pivot mount. The latch comprises a lower portion, a gripping handle and a pair of arms extending between the lower portion and the handle. The lower portion, gripping handle and arms define an opening therebetween configured to receive the locking post.

The latch is pivotally moveable between a locked position and an unlocked position. In the locked position the distended latch extends vertically upward and the locking post extends through the latch opening to mate with the latch. In the unlocked position the latch is relaxed and extends horizontally within the body recess.

In another aspect the disclosure relates to a container comprising a body, a lid, a pivot mount, a locking post and a resiliently flexible latch. The body defines an opening and comprises a front wall. The front wall has an outer surface and a top edge. The front wall defines a body recess that extends inwardly from the outer surface and downwardly from the top edge.

The lid is moveable between a closed position in which the lid covers the opening and an open position in which the lid does not cover the opening. The lid comprises a top panel and a front panel extending downward from the top panel to a front panel lower edge. The lid front panel defines a lid recess that extends inwardly from the front panel and upwardly from the front panel lower edge.

The pivot mount is attached to the body within the body recess.

The locking post extends outwardly from the front panel within the lid recess.

The locking post may have an engagement surface and a raised front edge configured to prevent the latch from inadvertently disengaging from the locking post.

The latch is pivotally mounted to the pivot mount and may move between a locked position in which the latch is distended and engages the locking post and an open position in which the latch is relaxed and is positioned within the body recess. The latch may define a latch opening configured to receive the locking post when the latch is in the locked position.

In one refinement the lid may further comprise a planar vertical surface located within the lid recess and extending upward from the front panel lower edge and terminating in a recessed edge. The lid may further comprise a beveled surface extending upward and rearward from the recessed edge. When the latch is in the locked position, the latch handle may extend above the recessed edge so that the latch handle and the beveled lid define a gap therebetween for accommodating an operator's fingers.

In another refinement an underside of the locking post may be chamfered at a predetermined angle, and a back (lid facing) surface of the latch handle may also be chamfered at about the same predetermined angle.

In another aspect a container is provided comprising a body, a lid, a pivot mount, a locking post and a resiliently flexible latch. The body defines an opening and comprises a front wall having an outer surface and a top edge. The front wall defines a body recess extending inwardly from the front wall outer surface and downwardly from the top edge. The lid is moveable between a closed position in which the lid covers the opening and an open position in which the lid does not cover the opening. The lid comprises a top panel and a front panel extending downward from the top panel to a front panel lower edge. The lid front panel defines a lid recess extending inwardly from the front panel and upwardly from the front panel lower edge. The pivot mount is attached to the lid within the lid recess. The locking post 66 is attached to the body within the body recess. The latch is pivotally mounted to the pivot mount and is moveable between a locked position in which the latch is distended and engages the locking post and an open position in which the latch is relaxed and is positioned within the body recess.

THE DRAWINGS

DETAILED DESCRIPTION OF THE INVENTION

Figure 1:
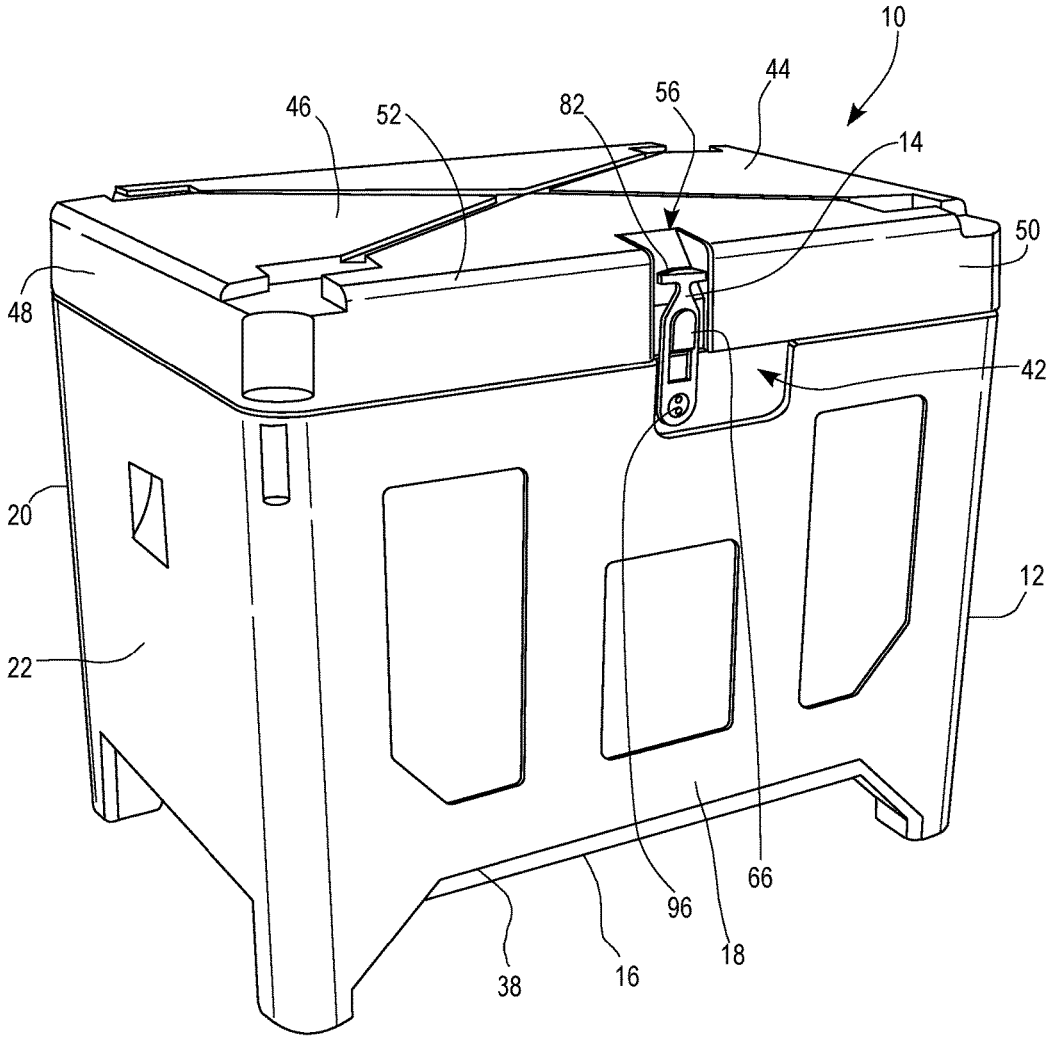
FIG. 1 is a perspective view of a container according to the disclosure shown in a closed and locked position.
Figure 2:
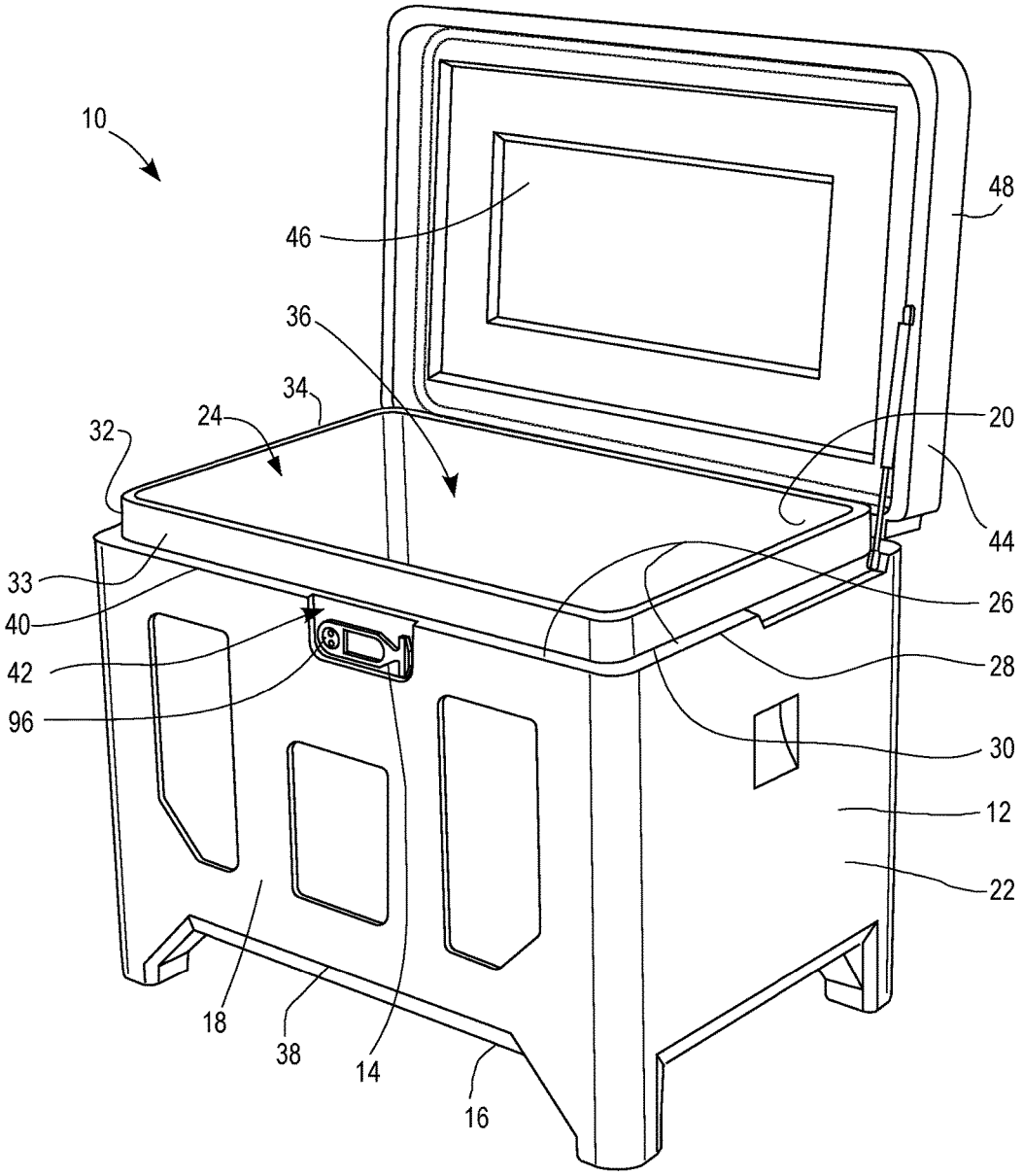
FIG. 2 is a perspective view of the container of FIG. 1 shown in an open and unlocked position.

While the disclosed container and pivoting latch may be embodied in many forms, there is shown in the drawings and will herein be described in detail one or more embodiments with the understanding that this disclosure is to be considered an exemplification of the principles of the container and pivoting latch and is not intended to limit the container and pivoting latch to the illustrated embodiments.

Terms such as "above" and "below", "rearward", "outward", "horizontal," "left," "right," "up," "down," "top," "bottom," "front" and "back," and "inward" (etc.), used as nouns, adjectives or adverbs (e.g. "rearwardly" , "outwardly", "horizontally, etc.) refer in this description to the orientation of the structure of the container as it is illustrated in the front views, such as FIGS. 1 to 4. For example, "rearward" refers to the direction toward the container rear wall 20 and "outward" refers to the direction away from the container body 12. Such terms are not intended to limit the invention to a particular orientation.

In addition, the terms "front face", "top wall", "sidewalls", "side edges", "bottom wall", "top edge of upper front face" and "bottom edge of lower front face" as applied to the container are for convenience only, and should not be construed as limiting the container to any particular shape.

Turning to the drawings, there is shown in FIGS. 1 to 5 one embodiment of the present disclosure, a container 10 having a body 12, a lid 44 and a pivoting latch 14 that minimizes the possibility of the latch 14 becoming entangled and then damaged.

The container body 12 has a bottom 16, a front wall 18, a rear wall 20 and opposing side walls 22 forming a unitary structure defining a storage space 24. The front wall 18, the rear wall 20 and the opposing side walls 22 extend upward from the bottom 16 and terminate in a ledge 26. The ledge 26 may extend partway or all the way around the periphery of the body 12 and has an outer perimeter 28 contiguous with the exterior surfaces of the front wall 18, rear wall 20 and/or opposing side walls 22, and an inner perimeter 30 set back from the exterior surfaces of the front wall 18, rear wall 20 and/or opposing side walls 22.

A body flange 32 extends upward from the inner perimeter 30 of the ledge 26 and terminates in a rim 34. The rim 34 defines an opening 36 communicating with the storage space 24.

The front wall 18 may be substantially planar, and extends from a bottom edge 38 to a top edge 40 which is coextensive with the front facing part of the outer perimeter 28 of the ledge 26. The front wall 18 defines a body recess 42 near the front wall top edge 40 which, as explained below, communicates with a lid recess 56.

The container further comprises a lid 44 hingedly attached to the body 12. The lid 44 has a closed position in which the lid 44 covers the opening 36, and an open position which allows access to the storage space 24. The lid 44 may comprise a top panel 46 and a lid flange 48 extending downward from the top panel 46. The lid 44 and, more particularly, the lid flange 48, fits against the body flange 32 and preferably the outer facing surface 33 of the body flange 32. The lid flange 48 abuts the ledge 26 when the container 10 is closed. The lid flange 48 has a front panel 50 that extends downward from a front panel upper edge 52 to a front panel lower edge 54.

Figure 3:
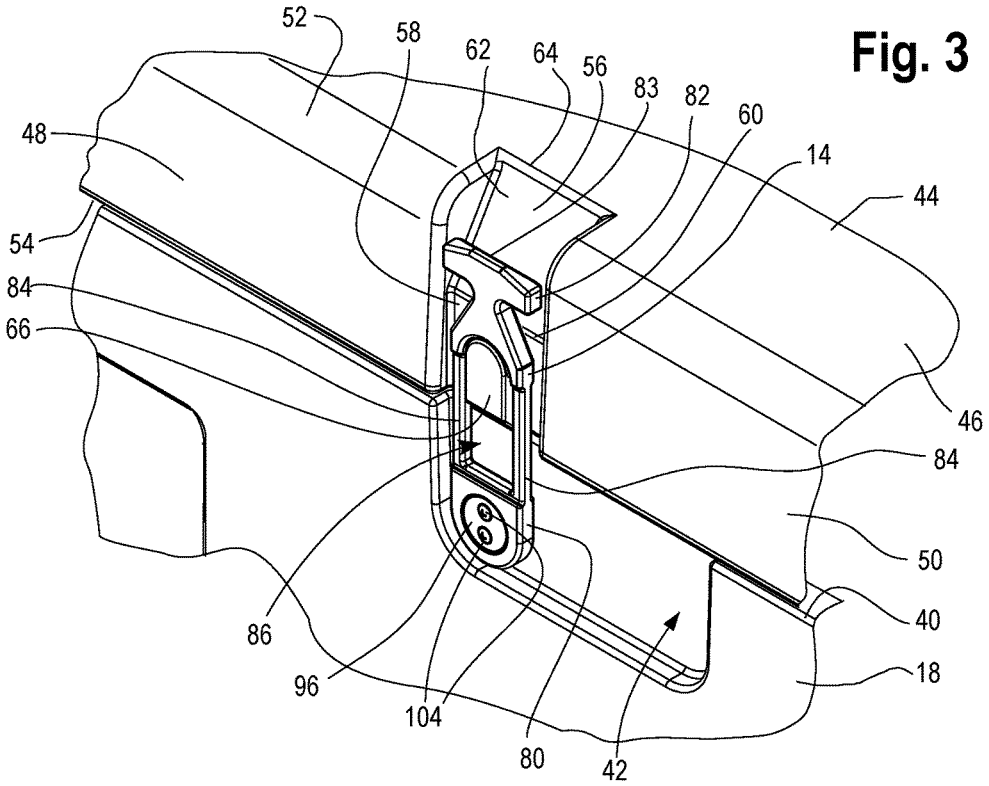
FIG. 3 is a close up view of a portion of the container of FIG. 1, showing the latch in the locked position.
Figure 4:
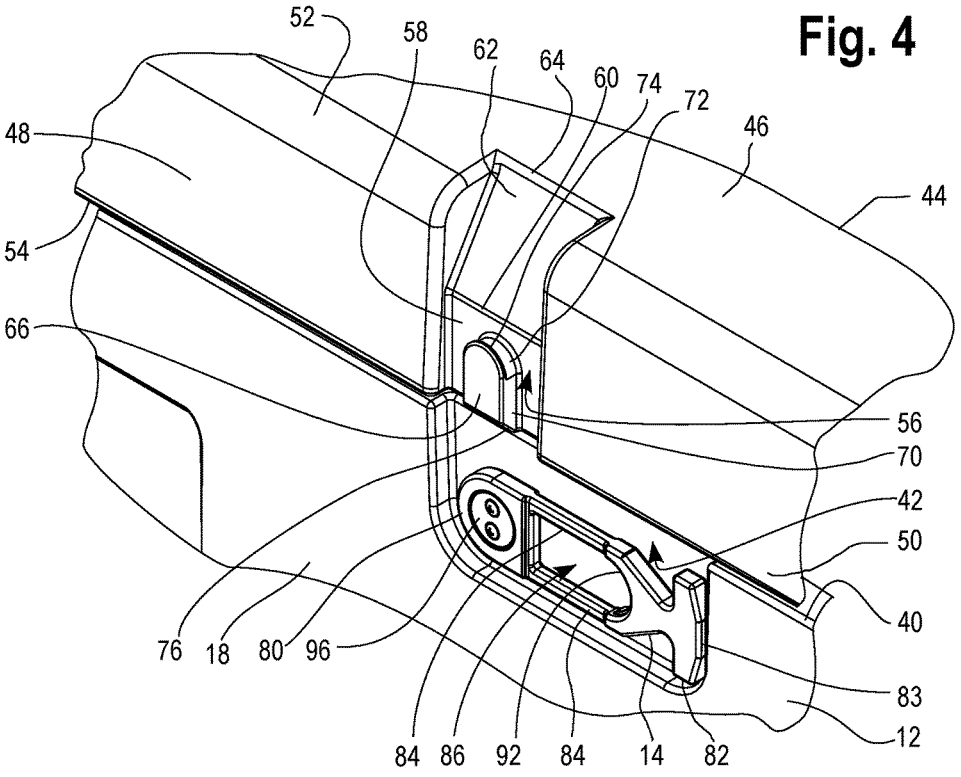
FIG. 4 is a close up view of a container showing the latch in the unlocked position.
Figure 5:
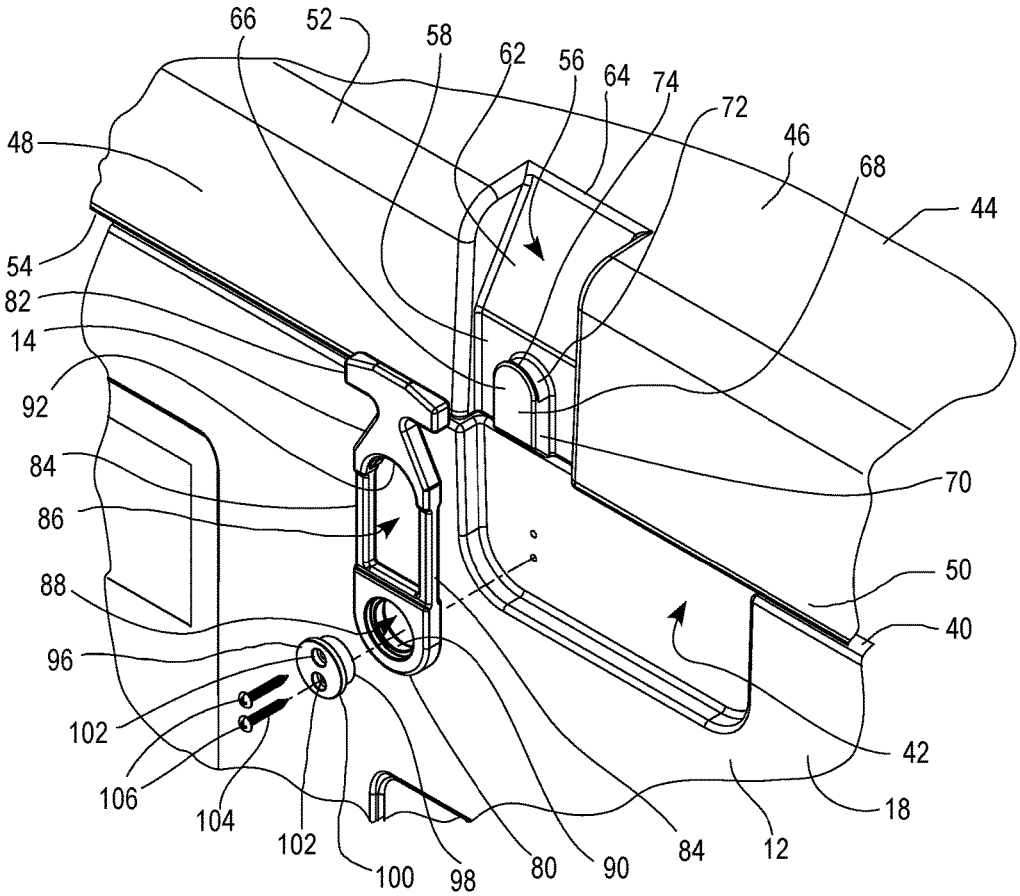
FIG. 5 is an exploded view of the container and latch of FIG. 3.

As best shown in FIGS. 3 and 4, the lid top panel 46 and the lid front panel 50 define a lid recess 56 which communicates with the body recess 42. The lid 44 further comprises a planar vertical surface 58 located within the lid recess 56 and extending upward from the front panel lower edge 54. The vertical surface 58 terminates in a recessed edge 60. A beveled surface 62 extends upward and rearward from the recessed edge 60 and terminates in a top edge 64 that may be coplanar with the lid top panel 46. The beveled surface 62 creates a gap between the latch handle 82 and the lid 44 when the latch 14 is in the locked position, making it easier for an operator to get his fingers around the handle 82.

A locking post 66 extends forward from the vertical planar surface 58. The locking post 66 has a front surface 68, sides 70 and a top surface 72. The top surface 72 is configured to engage the latch 14 and may be arced or any suitable shape. The locking post 66 may be molded into the lid 44. The top surface 72 of the locking post 66 has a raised front edge 74 to prevent the latch 14 from slipping off. As described below, the latch 14 has a matching countersunk area 92 for mating with the raised front edge 74.

The underside 76 of the locking post 66 may be chamfered at a 45° angle to match a similar 45° chamfered surface 83 on the back of the latch handle 82. This allows the lid 44 and latch 14 to glance off each other if the lid 44 is lowered with the latch 14 rotated in the up/closed position. This configuration also helps prevent the latch 14 from buckling and positioning itself under the lid 44, requiring the lid 44 to be lifted to grab the latch 14.

The latch 14 may be resiliently flexible and may be made of rubber or any suitable material. The latch 14 comprises a lower portion 80, a gripping handle 82 and a pair of arms 84 extending between the lower portion 80 and the handle 82. The lower portion 80, gripping handle 82 and arms 84 define an opening 86 therebetween. The opening 86 includes a countersunk area 92 at the top which mates with the locking post 66. The arms 84 may be relatively thinner than the rest of the latch 14 to allow the latch to stretch when pulled over the raised front edge 74 of the locking post 66.

The latch 14 is pivotally mounted to the container body 12 by a round pivot mount 96. The pivot mount 96 may be a separate component attached to the body 12 or the pivot mount 96 and the body 12 may form a single unitary structure. The pivot mount 96 comprises a cylindrical body 98 and a flange 100 extending from the forward end of the cylindrical body 98. The pivot mount 96 defines fastening holes 102 and may be attached to the container body 12 with sheet metal screws or any suitable fasteners 104, including without limitation machine screws and rivets. The holes 102 for the fasteners 104 have counterbores to keep the fastener heads 106, if any, recessed within the holes 102 to maintain a thin, flat profile. Preferably, the pivot mount 96 is made from a material that minimizes friction with the rubber latch 14 and allows the latch 14 to pivot easily. For example, the pivot mount 96 can be molded from a hard rubber, but it could also be made from various other materials such as thermoplastics and metals.

The pivot mount 96 keeps the latch 14 captive to the container body 12 while allowing the latch 14 to pivot freely within a plane. The lower portion 80 of the latch 14 defines a circular mounting hole 88 which in turn defines a counterbore 90 to keep the latch 14 flush with the pivot mount 96 and to maintain a thin overall profile.

The latch 14 engages the lid 44 via the locking post 66. As noted above, the top surface 72 of the locking post 66 has a raised front edge 74 to prevent the latch 14 from slipping off. The latch 14 has matching countersunk area 92 for the raised front edge 74 to engage.

The underside 76 of the locking post 66 may be chamfered at a 45° angle to match a similar 45° chamfered surface 83 on the back side of the handle 82. This allows the lid 44 and the latch 14 to glance off each other if the lid 44 is lowered with the latch 14 rotated in the up/closed position. This configuration also helps prevent the latch 14 from buckling and positioning itself under the lid 44, requiring the lid 44 to be lifted to grab the latch 14.

The latch 14 pivots in a flat plane about the pivot mount 96. This allows the latch 14 to be placed within the body recess 42 so that the latch 14 does not project beyond the footprint of the container 10 when the lid 44 is in the open or closed positions. This also minimizes the possibility of the latch 14 becoming entangled and then damaged.

The latch 14 is pivotally moveable from a locked position as shown in FIG. 3 (in which the latch 14 extends vertically upward, the gripping handle 82 extends within the lid recess 56, and the locking post 66 extends through the latch opening 86), and an unlocked position as shown in FIG. 4 (in which the latch 14 extends horizontally within the body recess 42). While in the locked position the latch 14 slightly distended. In the open position the latch 14 is relaxed.

To open the container 10, the user lifts up on the latch, stretching it slightly so that the latch 14 can be released from the locking post 66, then pulls the handle 82 slightly away from the container body 12 so that the latch 14 can clear the lid 44. The user then rotates the latch 14 ninety degrees and releases it so that the latch 14 resides within the body recess 42. The latch 14 will quickly return to its relaxed shape and lay flush against the body 12 within the body recess 42. The lid 44 can then be raised to allow access to the storage space 24.

To close the container 10, with the lid 44 down, the user lifts the handle 82 slightly away from the container body 12 so that the latch 14 can clear the lid 44 and rotates the latch 14 ninety degrees. When the latch 14 is rotated ninety degrees to the vertical (upright) position the user lifts upward and rearward on the handle 82, stretching the latch 14 slightly, until the latch engages the locking post 66. The locking post 66 will be within the latch opening 86. The user then releases the latch 14, causing it to engage the locking post 66, which secures the lid 44 container 10.

It is understood that the embodiments of the latch system described above are only particular examples which serve to illustrate the principles of the latch system. Modifications and alternative embodiments of the latch are contemplated which do not depart from the scope of the latch system as defined by the foregoing teachings and appended claims. It is intended that the claims cover all such modifications and alternative embodiments that fall within their scope.

For example, although in the latch system described above the pivot mount 96 is attached to the container body 12 and the locking post 66 is attached to the lid 44, it could be the other way around, with the pivot mount 96 (and thus the latch 14) attached to the lid 44 and the locking post 66 attached to the container body 12. The recesses defined by the container body 12 and the lid 44 could be reconfigured to accommodate this alternative latch system.

The invention claimed is:

1. A container comprising:

a body comprising a bottom wall, a front wall, a rear wall and opposing side walls forming a unitary structure defining a storage space, the front wall, the rear wall and the opposing side walls extending upward from the bottom wall and terminating in a ledge, the ledge having an outer perimeter and an inner perimeter, the body further comprising a body flange extending upward from the inner perimeter of the ledge and terminating in a rim, the rim defining an opening communicating with the storage space, the front wall having a top edge and defining a body recess near the front wall top edge;

a lid moveable between a closed position in which the lid covers the opening and an open position allowing access to the storage space, the lid comprising a top panel and a lid flange extending downward from the top panel, the lid flange comprising a front panel extending downward from a front panel upper edge to a front panel lower edge, the lid top panel and the lid flange front panel defining a lid recess which communicates with the body recess, the lid further comprising a vertical surface located within the lid recess and extending upward from the front panel lower edge, the lid further comprising a locking post extending forward from the vertical surface, the locking post having a top surface, the top surface having a raised front edge;

a pivot mount extending outwardly from the body within the body recess; and a resiliently flexible latch pivotally mounted to the pivot mount, the latch comprising a lower portion, a handle and a pair of arms extending between the lower portion and the handle, the lower portion, the handle and the pair of arms defining a latch opening therebetween, the latch opening configured so that the latch can mate with the locking post;

wherein the latch is pivotally moveable between a locked position in which the latch is distended and extends vertically upward and the locking post extends through the latch opening to mate with the latch, and an open position in which the latch is relaxed and extends horizontally within the body recess.

2. The container of claim 1 wherein the lid is hingedly attached to the body.

3. The container of claim 1 wherein the pivot mount is a separate component attached to the body.

4. The container of claim 1 wherein the pivot mount and the body form a single unitary structure.

5. A container comprising:

a body defining an opening and comprising a front wall, the front wall having an outer surface and a top edge, the front wall defining a body recess extending inwardly from the front wall outer surface and downwardly from the top edge;

a lid, the lid being moveable between a closed position in which the lid covers the opening and an open position in which the lid does not cover the opening, the lid comprising a top panel and a front panel extending downward from the top panel to a front panel lower edge, the lid front panel defining a lid recess extending inwardly from the front panel and upwardly from the front panel lower edge;

a pivot mount attached to the body within the body recess;

a locking post extending outwardly from the front panel within the lid recess; and a resiliently flexible latch pivotally mounted to the pivot mount and moveable between a locked position in which the latch is distended and engages the locking post, and an open position in which the latch is relaxed and is positioned within the body recess;

wherein the latch comprises a lower portion adjacent to and flush with the pivot mount in both the locked and unlocked positions;

wherein the locking post has an engagement surface and a raised front edge configured to prevent the latch from inadvertently disengaging from the locking post;

wherein the latch defines a latch opening configured to receive the locking post when the latch is in the locked position;

wherein the latch comprises a handle and a pair of arms extending between the lower portion and the handle;

wherein the lid further comprises a planar vertical surface located within the lid recess and extending upward from the front panel lower edge, the vertical surface terminating in a recessed edge, the lid further comprising a beveled surface extending upward and rearward from the recessed edge; and wherein, when the latch is in the locked position, the latch handle extends above the recessed edge and the latch handle and the lid define a gap therebetween for accommodating an operator's fingers.

6. The container of claim 5 wherein:

the body further comprises a bottom wall, a rear wall and opposing side walls, the bottom wall, the front wall, the rear wall and the opposing side walls forming a unitary structure defining a storage space.

7. The container of claim 6 wherein:

the front wall, the rear wall and the opposing side walls extend upward from the bottom wall and terminating in a ledge, the ledge having an outer perimeter and an inner perimeter.

8. The container of claim 7 wherein:

the body further comprises a body flange extending upward from the inner perimeter of the ledge and terminates in a rim, the rim defining an opening communicating with the storage space, the front wall having a top edge and defining a body recess near the front wall top edge.

9. The container of claim 5 wherein:

the lid is hingedly attached to the body.

10. The container of claim 5 wherein the pivot mount is a separate component attached to the body.

11. The container of claim 5 wherein the pivot mount and the body form a single unitary structure.

12. A container comprising:

a body defining an opening and comprising a front wall, the front wall having an outer surface and a top edge, the front wall defining a body recess extending inwardly from the front wall outer surface and downwardly from the top edge;

a lid, the lid being moveable between a closed position in which the lid covers the opening and an open position in which the lid does not cover the opening, the lid comprising a top panel and a front panel extending downward from the top panel to a front panel lower edge, the lid front panel defining a lid recess extending inwardly from the front panel and upwardly from the front panel lower edge;

a pivot mount attached to the body within the body recess;

a locking post extending outwardly from the front panel within the lid recess; and a resiliently flexible latch pivotally mounted to the pivot mount and moveable between a locked position in which the latch is distended and engages the locking post, and an open position in which the latch is relaxed and is positioned within the body recess; wherein the latch comprises a lower portion adjacent to and flush with the pivot mount in both the locked and unlocked positions and a latch handle connected to the lower portion;

an underside of the locking post is chamfered at a predetermined angle; and a back, lid facing, surface of the latch handle is chamfered at about the same predetermined angle.

13. A container comprising:

a body defining an opening and comprising a front wall, the front wall having an outer surface and a top edge, the front wall defining a body recess extending inwardly from the front wall outer surface and downwardly from the top edge;

a lid, the lid being moveable between a closed position in which the lid covers the opening and an open position in which the lid does not cover the opening, the lid comprising a top panel and a front panel extending downward from the top panel to a front panel lower edge, the lid front panel defining a lid recess extending inwardly from the front panel and upwardly from the front panel lower edge;

a locking post attached to the lid within the lid recess;

a pivot mount attached to the body within the body recess; and a resiliently flexible latch pivotally mounted to the pivot mount and moveable in a flat plane substantially parallel to the front wall between a locked position in which the latch is distended and engages the locking post, and an open position in which the latch is relaxed and is positioned within the body recess.

* * * * *